United States Patent [19]

Sparks

[11] 4,086,698

[45] May 2, 1978

[54] SAFETY GUARD FOR THE BLADE OF CARTON OPENERS

[75] Inventor: William F. Sparks, Stoneville, N.C.

[73] Assignee: Macfield Texturing, Inc., Madison, N.C.

[21] Appl. No.: 772,584

[22] Filed: Feb. 28, 1977

[51] Int. Cl.[2] ..... B26B 29/02

[52] U.S. Cl. ..... 30/2; 30/286

[58] Field of Search ..... 30/2, 286, 294

[56] References Cited

U.S. PATENT DOCUMENTS

| | | | |
|---|---|---|---|
| 390,759 | 10/1888 | DeLamarre | 30/286 |
| 2,293,892 | 8/1942 | Evinger | 30/286 |
| 2,376,887 | 5/1945 | Walters | 30/2 X |
| 2,743,523 | 5/1956 | Honey | 30/294 X |
| 3,781,988 | 1/1974 | Jones | 30/286 X |

*Primary Examiner*—Gary L. Smith

[57] ABSTRACT

A blade guard is mounted to a conventional carton cutter for longitudinal, reciprocal movement between a "safe" position outwardly of and covering the tip of the cutter blade and a retracted position spaced inwardly from and exposing the tip and a portion of the blade. The guard is normally spring biased to the safe position, yet responsive to pressure against the carton wall to retract the guard until it passes the end of the carton wall in front of the blade.

2 Claims, 3 Drawing Figures

FIG. 1
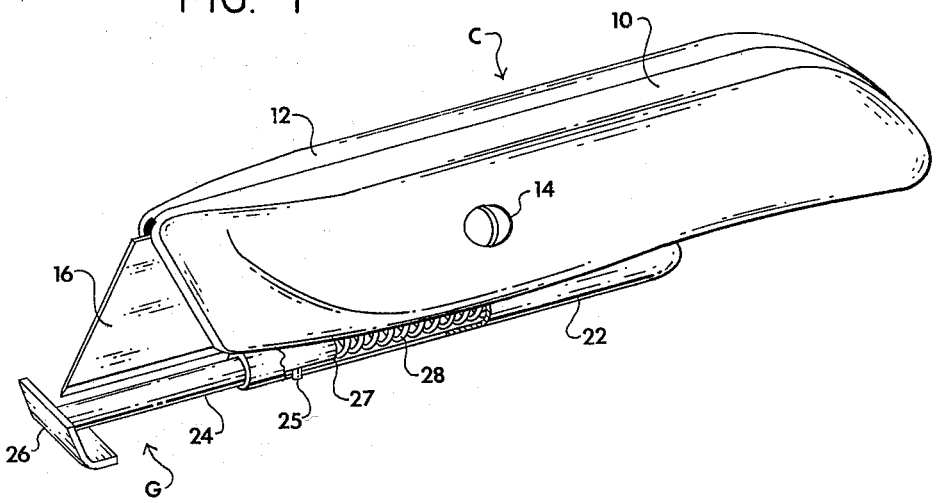
FIG. 2
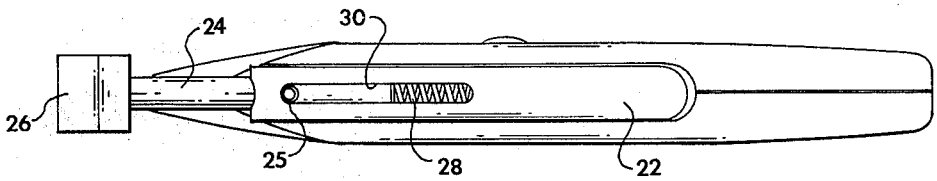
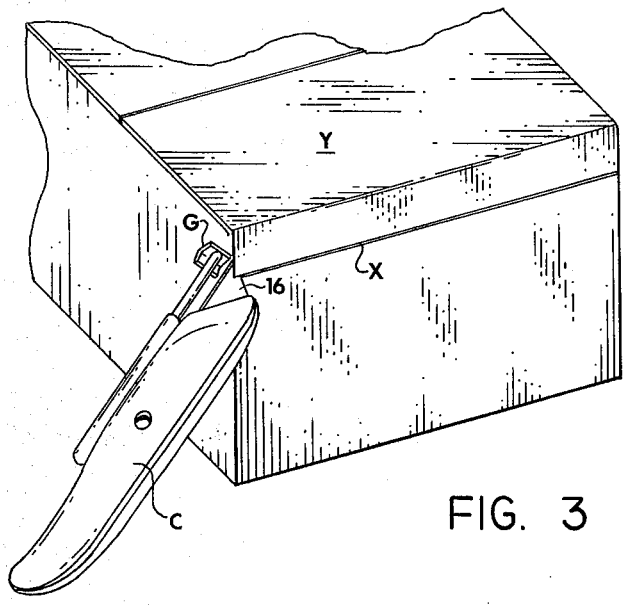
FIG. 3

SAFETY GUARD FOR THE BLADE OF CARTON OPENERS

BACKGROUND OF THE INVENTION

Through the years, the increase in shipping of goods and supplies in paper cartons has necessitated the development of an opening device which will allow workers to quickly and easily open cartons to remove goods and supplies therein. The conventional carton opener, which has thus developed, is an elongated handle formed of complimentary side walls and a cutting blade, generally in the form of a razor blade, disposed between the sides. In use, one end of the cutting blade protrudes longitudinally from one end of the handle between the complimentary sides. When not in use, the fastening member which holds the sides together can be loosened and the blade retracted for storage between the sides.

During the carton opening operation, however, the occasion often arises when a worker who is in a hurry and not using a sufficient degree of care will let the razor blade or cutter slip out of the carton wall or off the end thereof, with the result that the worker may injure himself or someone else in the immediate vicinity.

Previous safety guards have been developed, as illustrated in U.S. Pat. No. 2,73C,800 to Bailey; U.S. Pat. Nos. 3,052,977 to Wise; 2,376,887 to Walters; and 3,781,988 to Jones. The guards illustrated and described in each of these patents are all similar in some respects, yet all suffer the same shortcoming. That is, the blade emerges from the carton being opened previous to the emergence of the guard. Therefore, at the end of a cutting stroke, there is a moment of danger when the guard is retracted and the blade is exposed.

SUMMARY OF THE PRESENT INVENTION

The present invention, on the other hand, eliminates this problem because the guard is so designed and operates as to emerge first from the carton wall prior to the emergence of the blade. Therefore, by the time the blade completes its cut and emerges from the surface of the carton, it is already protected and remains so until its next insertion through the carton wall.

The construction of the guard which leads to such a desirable result includes a longitudinally reciprocal guard member which moves parallel and closely adjacent to the exposed edge of the blade from a point immediately beyond the tip end thereof to a retracted position in which the tip end and a portion of the blade is exposed. The blade exposure lasts only while a retracting pressure is applied to the guard which is normally spring biased to the safe position.

It is therefore an object of the present invention to provide an improved guard for carton cutters.

It is another object of the present invention to provide an improved cutter guard construction for carton openers of the type described in which the guard is normally spring biased to a safe position overlying the blade and its tip.

It is a further object of the present invention to provide a carton opener guard of the type described wherein, as the cutting stroke is completed, the guard is moved to the safe position prior to the emergence of the blade and its tip, and provides immediate protection.

Other objects and a fuller understanding of the present invention will become apparent from a reading of the following detailed description of a preferred embodiment in view of the accompanying drawings in which:

FIG. 1 is a perspective view of the present invention with a portion of the guard supporting piston broken away;

FIG. 2 is a plan view of the device according to the present invention looking from the underside thereof; and FIG. 3 is a perspective view, illustrating the invention as used in its intended environment.

DETAILED DESCRIPTION OF THE PREFERRED EMBODIMENT

Turning now to the drawings, there is illustrated in FIGS. 1–3 the improved cutter guard G for conventional carton cutters C according to the present invention. Referring particularly to FIG. 1, the carton cutter is of fairly conventional design with a pair of side members 10, 12 held together by a clamping screw 14 through the body portions thereof. A longitudinally extending cutter blade 16, such as a razor blade or the like, protrudes longitudinally from the forward end of cutter C and is held in clamping relation between the side members 10, 12 and secured by clamping screw 14. The aforementioned construction is conventional and it is not believed that further description is required.

The cutter guard means G includes a tubular housing 22 having a closed, inner end and an open, outer end. The housing is secured to the underside of the cutter C by welding, or the like. Alternatively, it may be molded integrally with the side walls 10, 12 to form the tubular member 22 when the sides are placed together. In any event, a shaft 24 having a shoe or plate 26 on the outer end thereof is mounted for reciprocal movement within the passageway in tubular member 22. A compression or coil spring 28 is positioned between the inner end 27 of shaft 24 and the inner end of the passageway within tubular member 22. Stop member 25 extends downwardly from the shaft 24 and rides back and forth within a slot 30 in tubular member 22 to limit the outward movement of shoe 26. So arranged, the spring 28 normally biases the shaft 24 to the outermost position illustrated in FIG. 1. However, upon pressure exerted inwardly against the exposed surface of shoe 26, the shaft retracts against the spring pressure and exposes the tip end and a portion of the blade 16 for its useful purpose. Immediately upon a release of pressure, the shoe 26 moves outwardly to its safe position past the tip of blade 16 as illustrated in FIG. 1.

Turning now to FIG. 3, it is believed that the invention, and particularly the heart of the invention is best illustrated by describing what occurs as the cutter C moves along a cut line X in carton Y. As the cutter C approaches the end of the carton wall, the guard G realizes a release of pressure against foot 26. Thus, as the foot clears the end of the wall, it is urged outwardly, so that at the moment the cutter blade 16 reaches the end of the carton, the guard is already in the safe position. It is important to emphasize this is not the case with known safety guards of the prior art. The cutting blade in all of the prior art reaches the end of the carton wall prior to the time the guard is moved to the safe position. This "moment of danger" even though it may be short, is long enough to inflict injury to the operator or anyone in the vicinity of the carton end.

It is apparent that a preferred embodiment of the invention has been illustrated and described and various changes and modifications might be made without departing from the scope of the invention, which is set forth in the appended claims.

I claim:

1. In combination with a carton cutter of the type having a handle formed of complimentary sides and a cutting blade disposed between said sides and protruding longitudinally from one end of said handle a prescribed distance, an improved cutter guard comprising:

(a) a guard means attached to said handle and including a shoe movable in a longitudinal path between an extended, safe position wherein said shoe protrudes from said handle a distance at least as great as said prescribed distance and closely adjacent to the tip end of said blade and a second, retracted position in which said blade tip is exposed, said movement of the guard means from said first to said second position being responsive to initiation of a cutting action by said blade against a given surface;

(b) said longitudinal path of said guard means being parallel to and closely adjacent the exposed sharp edge of said blade with said shoe preceding said blade during a cutting stroke.

2. The improved cutter guard according to Claim 1 wherein said guard means includes a tubular housing attached to said handle, a shaft extending parallel to said cutter blade and received within said housing for reciprocal movement, said shoe attached to the free end of said shaft, and a spring within said housing and engaging said shaft for normally biasing said shoe to said safe position, the bias applied by said spring being overcome by the pressure required to penetrate and slit a carton wall with said cutter.

* * * * *